US005605365A

United States Patent [19]

George

[11] Patent Number: 5,605,365

[45] Date of Patent: Feb. 25, 1997

[54] DOOR SECURITY DEVICE

[76] Inventor: David L. George, 300 S. 24th St., San Jose, Calif. 95116

[21] Appl. No.: 505,376

[22] Filed: Jul. 21, 1995

[51] Int. Cl.[6] ..... E05C 17/32

[52] U.S. Cl. ..... 292/263; 292/DIG. 53

[58] Field of Search ..... 292/263, 262, 292/277, DIG. 53; 70/93

[56] References Cited

U.S. PATENT DOCUMENTS

| | | | |
|---|---|---|---|
| 3,869,886 | 3/1975 | Diaz | 70/93 |
| 3,924,886 | 12/1975 | Markovitch | 292/263 |
| 3,940,956 | 3/1976 | Stevens | 70/93 |
| 4,174,861 | 11/1979 | Drake | 292/269 |
| 4,493,501 | 1/1985 | Abel | 292/263 |
| 4,762,351 | 8/1988 | Bowman | 292/263 |

FOREIGN PATENT DOCUMENTS

| | | | |
|---|---|---|---|
| 63944 | 8/1892 | Germany | 292/263 |
| 7502591 | 9/1976 | Netherlands | 292/263 |

*Primary Examiner*—Rodney M. Lindsey
*Attorney, Agent, or Firm*—Michael J. Hughes; Mark E. Baze

[57] ABSTRACT

A door security device (10) is provided for effectively locking a door (22) that has been partially opened. The device (10) includes a base plate (12) that is screwed onto a door frame (14), a first hinge plate (16) that is connected to the base plate (12) at a first hinge joint (56), a second hinge plate (18) that is similarly connected to the first hinge plate (16) at a second hinge joint (64), and a door plate (20) that is mounted on the door (22) and which incorporates a pair of hinge ears (92 and 94) between which is received a uniquely shaped hinge tongue (90) that is present at the end of the second hinge plate (18). A latch pin (24) that is also uniquely shaped, is insertable, when the door (22) is in a closed position, into ear bores (104 and 106) and a tongue bore (102) that are present within the hinge ears (92 and 94) and hinge tongue (90) to form a third hinge joint (108). The shape of the hinge tongue (90) and the interaction thereof with a biasing ramp (96) lying between the hinge ears (92 and 94) is such that as the door (22) is opened and the hinge tongue (90) rotates, the ear bores (104 and 106) and tongue bore (102) are forced out of axial alignment. When this occurs, a narrow barrel portion (134) of the latch pin (24) still permits hinging action, while upper and lower stops (130 and 132) present on the latch pin (24) provide that the latch pin (24) is locked into place, thereby preventing removal of the latch pin (24) by an intruder.

16 Claims, 5 Drawing Sheets

DOOR SECURITY DEVICE

TECHNICAL FIELD

The present invention relates generally to locks, and more particularly to a locking device for a door whereby the door may be secured in a partially open position.

BACKGROUND ART

A large number of locking devices exist for the prevention of breaking and entering into a dwelling or similar structure. Many of these locks are directed towards security devices for limiting the degree to which a door may be opened (as opposed to locks that prevent any opening whatsoever). That the ability to secure a door in a partially open position for observation purposes to determine whether a visitor is friend or foe is highly desirable is an understatement, indeed, security devices performing this function may be required by law, or may be necessary in order for a hotel or similar establishment to obtain a desirable rating classification.

Perhaps most familiar is the releasable chain arrangement, wherein a chain is secured at one end in a permanent fashion, usually to the door frame, while the other end is retained in a slotted member mounted on the door. Such chains have the well-established fault of being weak in construction, both in terms of the chain-link material, which may be easily cut with bolt-cutters or broken under force, and in terms of the strength of the chain mountings, which provide relatively small resistance to the door being kicked or pushed open and the chain being ripped from its moorings. Chain-type limiting devices have the further fault of permitting disablement by the extension of a hand or tool through the partially opened door and the consequent not so difficult unfastening of the releasable end of the chain from the door. In addition, chain locks may be difficult for the elderly and handicapped to operate, since they require a certain degree of dexterous manipulation and precision of alignment to engage the chain in the slotted member.

In an effort to overcome the limitations of the chain-type lock, there exist in the prior art a number of devices analogous to the chain lock for permitting a door to be securably opened only a limited distance. It is perhaps most common that such devices incorporate pivoting or hinged members that are in some fashion linked together. A simple example is shown in U.S. Pat. No. 3,940,956, issued to Stevens on Mar. 2, 1976. Steven's device consists of a first arm pivotally mounted to a door frame and a second arm pivotally mounted to the door. The mountings are so as to permit a horizontal pivoting. The free end of each arm has a hole. The holes of the two arms are aligned to receive the shackle of a common padlock, which links the two arms together thereby permitting only a partial opening of the door to the limit as reached by the two linked arms. This arrangement is awkward since it requires a supplemental lock for which a key or combination number must be used.

A more elaborate example is shown in U.S. Pat. No. 3,924,886, issued to Markovitch on Dec. 9, 1975. With this invention, a cylindrical "latchplate" having a T-shaped slot is mounted on the door frame. A "latchlink" T-shaped end is pivotally and slideably mounted on the door. When a secured partial door opening is desired, the T-shaped end of the latchlink is slid toward the door frame to be mateably inserted into the slot of the latchplate. The latchlink is then held within the latchplate as the door is opened and a simultaneous rotation and engagement of the latchlink within the latchplate occurs. This device is rather more complex than is necessary, and it is not clear that insertion and corresponding engagement of the latchlink within the latchplate would always be smooth and trouble free.

Numerous other door security devices are equally complex, if not more cumbersome in design and application, or have inherent in their design the possibility that the device may be rendered unsecure by an intruder's reaching through the partially opened door. (See for example U.S. Pat. No. 4,174,861, issued to Drake on Nov. 20, 1979, wherein a sliding pivot pin is employed having a threaded retaining head which it appears possible could be unscrewed by an intruding hand, thereby allowing withdrawal of the pin and a consequent deactivation of the security device.)

Because of the limitations associated with most presently available locks for permitting a partial, secured door opening, a substantial need still exists for such a door security device that is both simple in operation and construction, and that cannot be deactivated by an attempted intruder.

DISCLOSURE OF THE INVENTION

Accordingly, it is an object of the present invention to provide a door security device that allows a limited opening of a door.

It is another object of the invention to provide a door security device that has great strength in both construction and in the mounting thereof.

It is a further object to provide a door security device that may not be unlocked from the outside of the door.

It is yet another object to provide a door security device that is simple in construction and materials.

It is yet a further object to provide a door security device that is very easy to use.

It is still another object to provide a door security device that may be employed with a variety of door types.

It is a still further object to provide a door security device that does not significantly detract from the aesthetic appearance of the door and doorway.

And it is yet another object of the present invention to provide a door security device that may be made with variable strength ratings for a variety of applications.

Briefly, the preferred embodiment of the present invention is a door security device for effectively locking a door that has been partially opened. The device includes a base plate that is screwed onto a door frame, a first hinge plate that is connected to the base plate at a first hinge joint, a second hinge plate that is similarly connected to the first hinge plate at a second hinge joint, and a door plate that is mounted on a door and which incorporates a pair of hinge ears between which is received a uniquely shaped hinge tongue that is present at the end of the second hinge plate. A latch pin that is also uniquely shaped, is insertable, when the door is in a closed position, into ear bores and a tongue bore that are present within the hinge ears and hinge tongue to form a third hinge joint. The shape of the hinge tongue and the interaction thereof with a biasing ramp lying between the hinge ears is such that as the door is opened and the hinge tongue rotates, the ear bores and tongue bore are forced out of axial alignment. When this occurs, a narrow barrel portion of the latch pin still permits hinging action, while upper and lower stops present on the latch pin provide that the latch pin is locked into place, thereby preventing its removal by an intruder.

An advantage of the present invention is that it is impossible for an intruder to unlock the activated device with the door open.

Another advantage of the invention is that the strength of the device is such that failure of the structural materials comprising the door and door frame will be required to occur before a corresponding failure of the locking ability of the device occurs, thereby severely limiting the means by which an intruder can break in.

A further advantage is that the door security device is intuitively simple to operate.

Yet another advantage is that the door security device may be employed extremely easily and rapidly, thereby encouraging its use.

Yet a further advantage is that the device may be used by many handicapped and disabled persons.

Still another advantage is that the device is simple and inexpensive to manufacture.

A still further advantage of the present invention is that the device may be readily employed with doors that are not properly aligned within the door frame.

These and other objects and advantages of the present invention will become clear to those skilled in the art in view of the description of the best presently known mode of carrying out the invention as described herein and as illustrated in the several figures of the drawings.

BEST MODE FOR CARRYING OUT THE INVENTION

Figure 1:
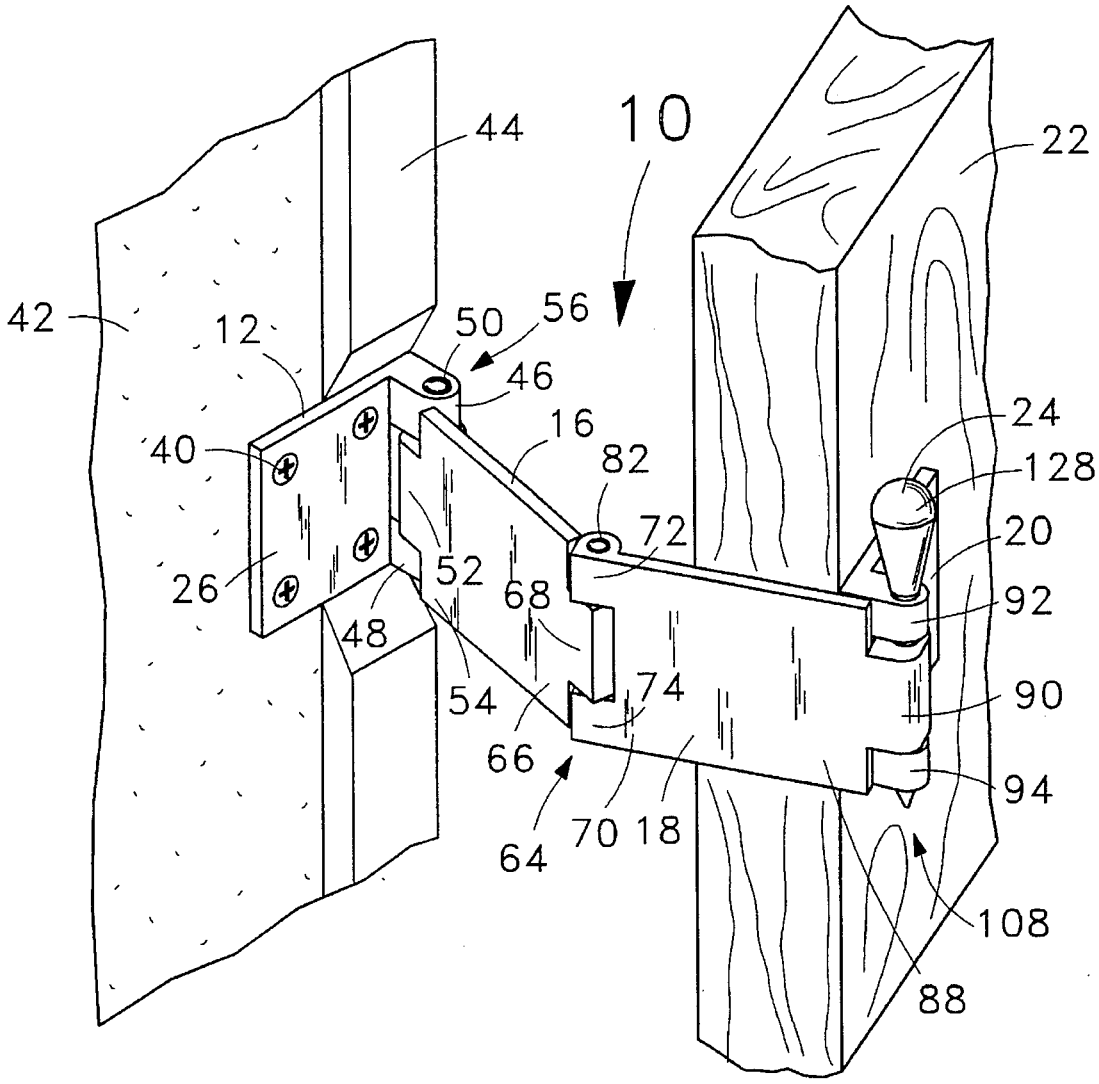
FIG. 1 is a perspective view of the implemented door security device of the preferred embodiment of the present invention.

The preferred embodiment of the present invention is a door security device for providing a secured, partial opening of a door. The door security device of the preferred embodiment is illustrated and set forth in a perspective view in FIG. 1, where it is designated therein by the general reference character 10.

Figure 2:
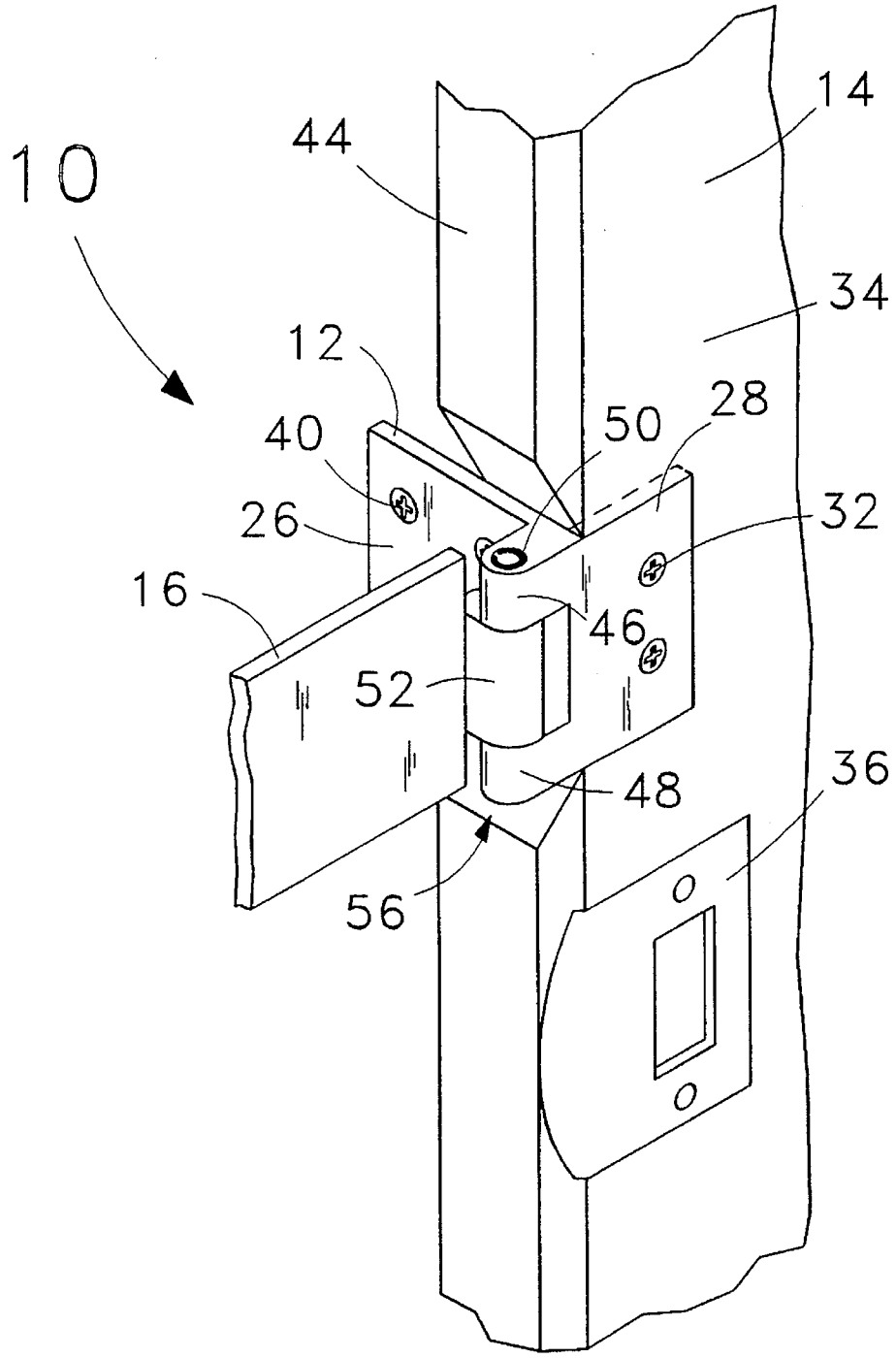
FIG. 2 is partial perspective view of the door security device from a viewpoint which allows observation of the inside of the door frame.

Referring initially to FIGS. 1 and 2 of the drawings, the door security device 10 is shown to be comprised of five major parts. A base plate 12 is configured to be mounted to a door frame 14. A first hinge plate 16 extends from the base plate 12 and is linked to a second hinge plate 18. A door plate 20 is adapted to be mounted to a door 22. And a latch pin 24 is used to hingedly lock the second hinge plate 18 to the door plate 20.

Figure 3:
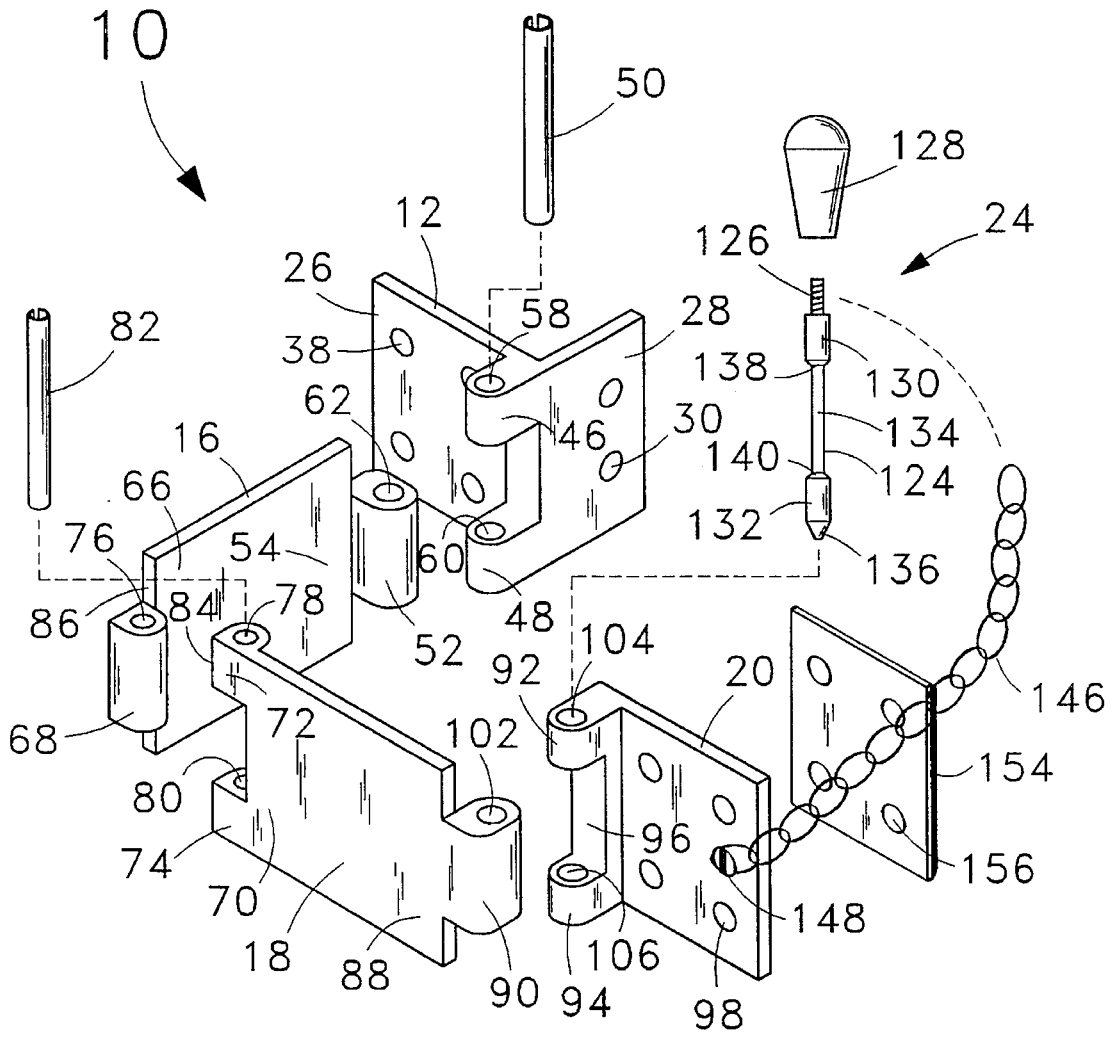
FIG. 3 is an exploded perspective view of the door security device of FIG. 1.

Referring now to the exploded view of FIG. 3, and also to FIGS. 1 and 2 as appropriate, the base plate 12 has a generally L-shaped configuration. What may be thought of as the two "legs" of the L are denoted as a wall plate 26 and a jamb plate 28. Both the wall plate 26 and the jamb plate 28 have a solid rectangular shape. The jamb plate 28 has holes 30 to receive wood screws 32 (see FIG. 2) for attaching the base plate 12 to the interior portion of the door frame 14, this interior portion being referred to herein as a jamb face 34. In order that the door 22 may close, the jamb plate 28 is recessed within the jamb face 34 as is similarly and conventionally done for a shown door knob strike plate 36. The other "leg" of the L, the wall plate 26, is also provided with holes 38 to receive wood screws 40 for attaching the base plate 12 to a wall 42 side of the door frame 14. Because many door flames 14 are provided with a decorative molding 44, it will generally be the case that the wall plate 26 will be recessed within this molding 44, since for the device 10 to function properly, and not bind during the operation thereof, the wall plate 26 and the door plate 20 must be nearly coplanar when the door 22 is in the closed position. It will be observed that when the base plate 12 is mounted to the door frame 14, the wood screws (32 and 40) will enter into the door frame 14 (or more specifically, vertical wood studs thereof, usually a double "two-by-four") at perpendicular angles, as is required by the wall plate 26 and the jamb plate 28 forming a perpendicular juncture. In order to permit the wood screws (32 and 40) to "criss-cross," the holes 30 of the jamb plate 28 are offset from the holes 38 of the wall plate 26, that is, the holes (30 and 38) are present at different elevations. This criss-cross screw arrangement provides an exceptionally strong mooring for the door security device 10 within the door frame 14. In fact, the screw arrangement multiplies the overall strength of the screws (32 and 40) to the point that forcible removal of the mounted base plate 12 would require that relatively massive portions of wood "two-by-fours" be broken out as well. The screw arrangement also permits a sequential tightening that may be used to assist in aligning the device.

Continuing to refer to FIGS. 1 and 3, present at the juncture of the wall plate 26 and the jamb plate 28 are upper and lower hinge ears 46 and 48, respectively. The hinge ears (46 and 48), by way of a spring pin 50, cooperate with a first hinge tongue 52 present at a proximal end 54 of the first hinge plate 16 in order to form in combination a first hinge joint 56 of a type similar to the conventional hinge joints as are found on most doors. Thus, the upper and lower hinge ears (46 and 48) are provided with cylindrical ear bores 58 and 60, respectively. These ear bores (58 and 60) are in vertical alignment with one another and are in further vertical alignment with a similar tongue bore 62 present in the hinge tongue 52. Received by the ear and tongue bores (58, 60 and 62), then, is the spring pin 50. The spring pin 50 serves in an identical capacity to a hinge pin as is found in a conventional door hinge, but rather than having a typical pin form, the spring pin 50 has the form of a semi-circular tube of metal that is press-fitted within the tongue bore 62. The inside diameter of the ear bores (58 and 60) is slightly larger than that of the tongue bore 62, and thus the hinge ears (46 and 48), and correspondingly the first hinge plate 16, are allowed to pivot about the spring pin 50. A rivet could also be substituted for this spring pin 50, but unacceptable would be the typical loose type of hinge pin as is found on most doors, and which could be quickly removed by a determined intruder with a knife or screwdriver.

The linkage between the first and second hinge plates (16 and 18) is also in the form of a permanent second hinge joint 64 and is comprised of elements essentially identical to those just described. Thus, a distal end 66 of the first hinge plate 16 is provided with a second hinge tongue 68, while a proximal end 70 of the second hinge plate 18 is provided with upper and lower hinge ears 72 and 74, respectively (in the discussion herein, the use of the terms "proximal" and "distal" refer to those portions of a component of the door security device 10 lying, respectively, closest to and furthest from the door frame 14 when the door security device 10 is extended to the limit thereof). It is again the case that the second hinge tongue 68 is provided with a tongue bore 76 having a smaller diameter than that of ear bores 78 and 80 present in the upper and lower hinge ears (72 and 74), respectively. Further, the first and second hinge plates (16 and 18) pivot about a spring pin 82 of the same construction as spring pin 50.

The second hinge joint 64 as formed by the linkage of the first and second hinge plates (16 and 18) differs from the first hinge joint 56 as formed by the base plate 12 and the first hinge plate 16 in an important aspect. Whereas the first hinge plate 16 has an uninhibited rotational ability about spring pin 50, at least within the excluded angle defined by the wall plate 26 and the jamb plate 28, the linkage between the first and second hinge plates (16 and 18) is such that the first and second hinge plates (16 and 18) are able to form between themselves a variable included angle of no greater than slightly less than 180 degrees. This is a result of the second hinge tongue 68 mating within the hinge ears (72 and 74) so closely that over rotation of the second hinge plate 18, relative to the first hinge plate 16, is prevented due to abuttal of outer edges 84 of the hinge ears (72 and 74) against vertical edges 86 of the first hinge plate 16 when the door security device 10 is in a fully extended position. This limited angular movement of the first and second hinge plates (16 and 18), together with triangularly leveraged hinge points, provides that closure of the door 22, after a secured partial opening thereof, may always be effected without binding of the first and second hinge plates ( 16 and 18) and/or over rotation such that the first and second hinge plates (16 and 18) interferingly insert themselves between the door 22 and door frame 14.

It would be obvious to one with ordinary skill in the art that the second hinge joint 64 could be equivalently formed where the second hinge tongue 68 is incorporated into the proximal end 70 of the second hinge plate 18, and where the hinge ears 72 and 74 are incorporated into the distal end 66 of the first hinge plate 16. It should be further noted that the first and second hinge plates (16 and 18) need not have the form of "plates," but could rather have the form of a bar or other shape, although, importantly, the plate shape, with a larger width that is vertically oriented, makes it extremely difficult for any leveraging type cutter to be successfully employed by an intruder.

The interrelationship and structure of a distal end 88 of the second hinge plate 18, the door plate 20 and the latch pin 24, provide several features and aspects that are novel to the present invention and which will now be discussed in greater detail in this and succeeding paragraphs herein. Still referring to FIG. 1, and to FIG. 3 especially, two hinge tongues (52 and 68) have already been described as being present at the proximal and distal ends (54 and 66), respectively, of the first hinge plate 16. It will now be noted that yet a third hinge tongue 90 is present at the distal end 88 of the second hinge plate 18. Correspondingly, a third pair of upper and lower hinge ears 92 and 94, respectively, is present on the door plate 20. The door plate 20 additionally includes a biasing ramp 96, the relationship of which to the third hinge tongue 90 will be described shortly. The biasing ramp 96 is simply a flat, raised portion of the door plate 20 that is integral with and vertically disposed between the hinge ears (92 and 94). Holes 98 present in the door plate 20 and carriage bolts 100 and barrel nuts 101 (see FIG. 7) are employed in the mounting of the door plate 20 to the door 22. Within the hinge tongue 90 and each of the upper and lower hinge ears (92 and 94) are cylindrical tongue and ear bores 102, 104, and 106, respectively, and through which the latch pin 24 is inserted. The hinge ears (92 and 94), the hinge tongue 90, and the latch pin 24, in combination, create a third hinge joint 108, within which the latch pin 24 is free to be removed when the door 22 is in the closed position, and which is lockably held in place when the door 22 has been very minimally opened and an attempt by an intruder might be made to remove the latch pin 24 in order to gain entry.

It would be obvious to one with ordinary skill in the art that this assemblable third hinge joint 108 could also be located at the site of the first hinge joint 56, with the permanent first hinge joint 56 being correspondingly relocated to the door plate 20. The third hinge joint 108 could be located at the site of the second hinge joint 64 as well, although it would not be possible to obtain as "early" a lock-up of the latch pin 24 as is desirable (explained below). It is also obvious that the three hinge joints (56, 64 and 108) described need not each have only the two hinge ears (46 and 48, 72 and 74, or 92 and 94) and the one hinge tongue (52, 68, or 90). Indeed, the door security device 10 of the present invention has hinge ears and hinge tongues as shown for a model in which the height of the hinge plates (16 and 18) is 6.4 cm (2.5 in). For a second envisioned model, not shown, having 10.2 cm (4.0 in) hinge plates, three hinge ears and two hinge tongues would be incorporated. This second model would provide a two-and-one-half-fold increase in strength over the model shown herein for situations requiting an even greater strength than the 1850 pounds of pulling resistance already provided by the smaller model when made of the preferred material (to be described later herein). The door security device 10 is also operable with a hinge joint formed from a single hinge ear and a single hinge tongue.

Figure 4:
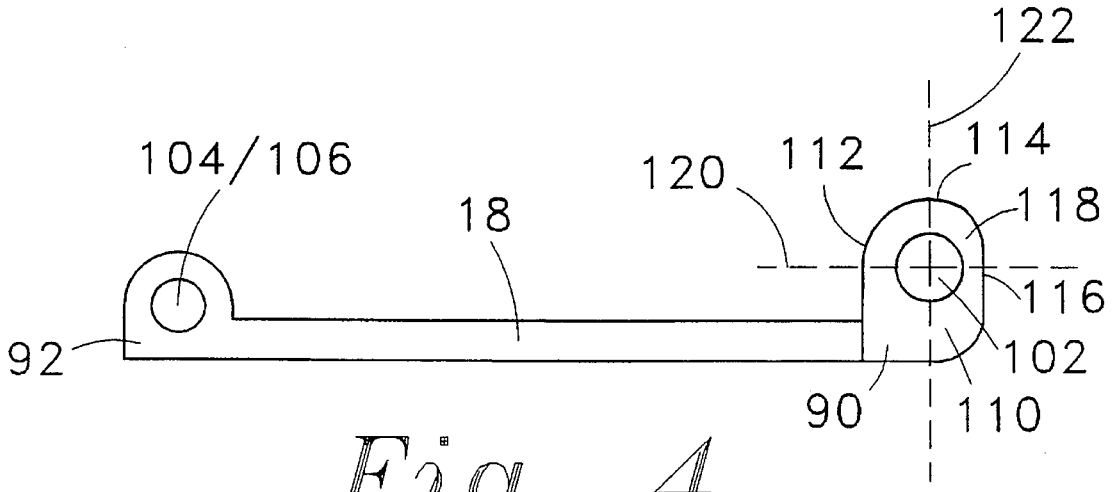
FIG. 4 is a top plan view of the second hinge plate.

Key to the operation of the door security device 10 is the location of the tongue bore 102 within the third hinge tongue 90, the particular arcuate shapes of certain of the outer surfaces of the hinge tongue 90, and the structure of the latch pin 24. As shown in FIG. 4, a closer examination of a top surface 110 of the hinge tongue 90 reveals that the tongue bore 102 is eccentrically positioned within the hinge tongue 90. Thus, the distance between the center of the tongue bore 102 and an inner periphery 112 or an intermediate periphery 114 is greater than the distance between the tongue bore 102 and an outer periphery 116. The thickness of a tongue bore wall 118 varies correspondingly. In the preferred embodiment, the tongue bore 102 has a diameter of 0.795 cm (0.313 in), with distances of 0.795 cm (0.313 in), 0.795 cm (0.313 in) and 0.635 cm (0.250 in) between the center of the tongue bore 102 and the inner, intermediate and outer peripheries (112, 114 and 116), respectively, the distances being measured along a parallel diametric line 120 or a perpendicular diametric line 122 as appropriate ("parallel" and "perpendicular" referring to the orientation of the diametric lines (120 and 122) as relative to the longitudinal direction of the second hinge plate). The ear bores (104 and 106) of the door plate 20 also have diameters of 0.795 cm (0.313 in), with centers located 0.635 cm (0.250 in) in perpendicular direction from the biasing ramp 96. The bidirectional off-set location of the tongue bore 102 (90 degrees from both the inner and intermediate peripheries (112 and 114)) is preferred to give protection from wear to both the tongue 90 and the biasing ramp 96, although a single off-set will also work.

When the door 22 is in the closed position (and the latch pin 24 is in position so as to form the third hinge joint 108), the biasing ramp 96 faces the outer periphery 116 and, correspondingly, the most narrow part of the tongue bore wall 118. At this point, the tongue bore wall 118 is sufficiently narrow such that contact of the biasing ramp 96 with the outer periphery 116 does not prevent the centers of the tongue and ear bores (102, 104 and 106) from being in vertical, axial alignment. Conversely, when the door is partially opened, the peripheries (112, 114 and 116) of the hinge tongue 90 are rotated with respect to the biasing ramp 96 so that the biasing ramp 96 faces either the inner or intermediary peripheries (112 and 114) (depending on the extent to which the door 22 has been opened), and thus the biasing ramp 96 faces a wider portion of the tongue bore wall 118. This width is sufficiently great so that axial alignment of the centers of the tongue and ear bores (102, 104 and 106) is impossible. The unique structure of the latch pin 24, the explanation of which follows immediately, provides that when these centers are in axial alignment, the latch pin 24 may be removed, while when the centers are not aligned, removal is prevented.

Referring again to FIG. 3 of the drawings, the latch pin 24 is seen to include a body 124 and a threaded head 126 upon which is screwed a knob 128. The body 124 has three primary features, all of which are integral, including an upper stop 130, a lower stop 132, and a barrel portion 134. Each of the upper and lower stops (130 and 132) and the barrel portion 134 have a cylindrical shape, with the upper and lower stops (130 and 132) having a diameter that is very slightly less than that of the tongue and ear bores (102, 104 and 106) and with the barrel portion 134 having a diameter substantially smaller still of 0.584 cm (0.230 in). The upper and lower stops (130 and 132) have lengths and are located on the body 124 so as to correlate with the ear bores (102 and 104). The smaller diameter barrel portion 134, then, correlates with the tongue bore 102. The latch pin 24 is also provided with a beveled tip 136, and with beveled transitions 138 and 140 which are present where the barrel portion 134 widens into the upper and lower stops (130 and 132), respectively. These beveled portions facilitate the insertion and removal of the latch pin 24 within the tongue and ear bores (102, 104 and 106).

When the center of the tongue bore 102 is in axial alignment with the centers of the ear bores (104 and 106), i.e., when the door 22 is in the closed position, the latch pin 24 is free to slide within the tongue and ear bores (102, 104 and 106), with free fall of the latch pin 24 being prevented by the knob 118 (or by a small washer inserted between the knob 128 and the top of the upper stop 130). When the door 22 is opened and the intermediate or inner peripheries (114 or 112) have rotated so as to face the biasing ramp 96 (and to be in close contact therewith), the smaller diameter of the barrel portion 134 provides that the hinge tongue 90 is still able to pivot about the body 124 of the latch pin 24, despite the fact that the center of the tongue bore 102 has moved out of alignment with the centers of the ear bores (104 and 106). On the other hand, removal of the latch pin 24 in these positions is prevented because the lower stop 132 is unable to pass through the tongue bore 102 due to the biasing action of the upper and lower hinge ears (92 and 94) upon the upper and lower stops (130 and 132) as brought about by the action of the biasing ramp 96 upon the inner or intermediate peripheries (112 or 114). That is to say, the diameter of the lower stop 1132 is caused to interferingly extend outside of the diameter of the tongue bore 102. Similarly, even if the knob 128 is removed by an intruding hand, the upper stop 130 is also unable to pass through the tongue bore 102, and thus the latch pin 24 is prevented from falling out or from being pushed out. A designed feature of the preferred embodiment is that when the biasing ramp 96 faces the appropriate inner or intermediate peripheries (112 or 114), wherein the latch pin 24 is lockably held in place, the dimensions as given are such that contact of the biasing ramp 96 against these surfaces completely relieves the latch pin 24 of any force that would be exerted by someone trying to forcibly open the door. Thus the latch pin 24 may not be sheared or unfunctionally deformed when the door security device 10 is under stress.

Figure 5:
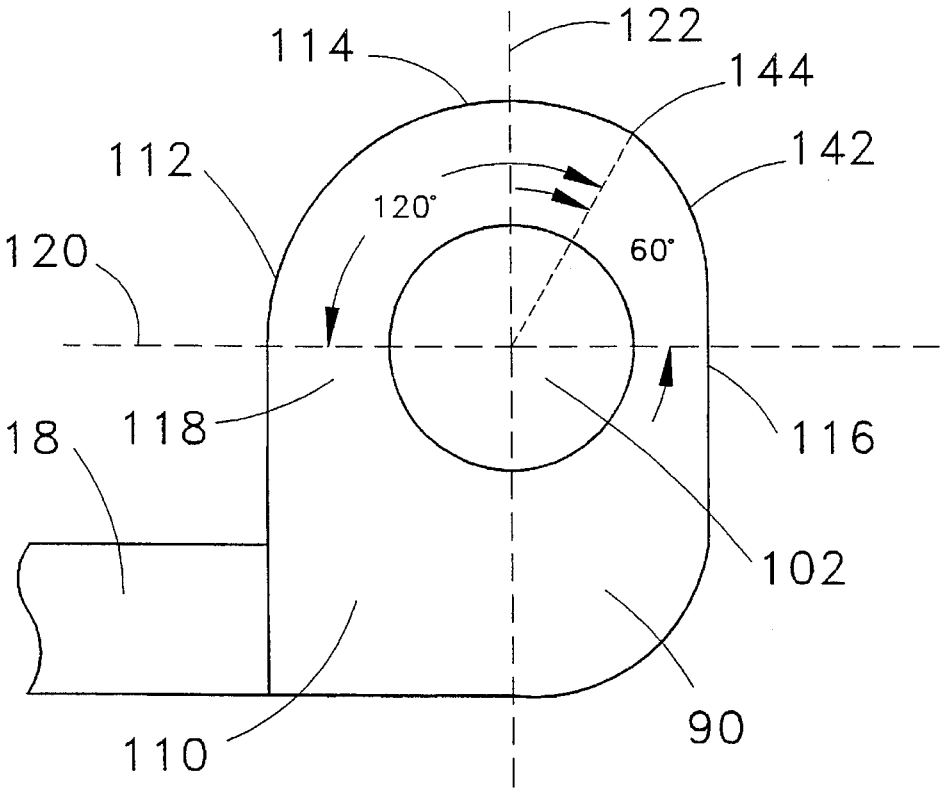
FIG. 5 is a top plan view of the third hinge tongue.

Up until this point, no mention has been made as to precisely at what point "lock-up" of the latch pin 24 occurs in the door security device 10 of the preferred embodiment. As shown in FIG. 5, a still closer examination of the third hinge tongue 90 reveals that between the intermediate and outer peripheries (114 and 116) there exists what will be denoted a transitional periphery 142. Whereas the inner and intermediate peripheries (112 and 114) have radii of 0.795 cm (0.313 in) which are calculated from the center of the tongue bore (102), the transitional periphery 142 has a shorter radius of 0.635 cm (0.25 in) which is calculated from a point displaced 0.198 cm (0.078 in) along the perpendicular diametric line 122 (in the direction of the intermediate periphery 114). The radii of the inner and intermediate peripheries (112 and 114) define an arc extending 120 degrees from the parallel diametric line 120 to a change point 144. From the change point 144, the radius of the transitional periphery 142 then defines an arc of 60 degrees. The transitional periphery 142 is introduced to provide that the tongue bore wall 118 widens as quickly as possible from its most narrow point at the outer periphery 116 to the change point 144. When the hinge tongue 90 has been rotated so that the biasing ramp 96 is normal to the change point 144, it is at that change point 144 that the latch pin 24 is fully locked within the hinge joint 108, and the latch pin 24 remains locked upon further rotation of the hinge tongue 90 (i.e., upon further opening of the door 22 and further extension of the door security device 10). The hinge tongue 90 is rotated to where the biasing ramp 96 is normal to the change point 144 when the door 22 has been opened from the fully closed position by only approximately 1.91 cm (0.75 in). Since a typical door has a width of only 3.81 cm (1.5 in), it will be noted that the door security device 10 becomes locked before even the most narrow line of sight to the interior of a dwelling or enclosure is available. The rapidity with which the door security device 10 locks-up may be increased further still by shortening the overall length of the second hinge plate 18 (the first and second hinge plates (16 and 18) of the preferred embodiment each have a length of 10.2 cm (4.0 in)). This results in a smaller inception angle for applications such as sliding doors.

The door security device 10 is envisioned as being provided with at least two methods for ensuring that the latch pin 24 is always available for employment with the device 10. The use of these methods depend on the environment in which the door security device 10 will be used, and in both cases the latch pin 24 is physically attached to the door plate 20. Where the device 10 is to be used in the dwelling of a handicapped or otherwise disabled person, and as indicated in FIG. 3, it is preferred that the latch pin 24 be attached by a chain 146 interposed between the threaded head 126 and the knob 128, and attached to the door plate 20 by a screw 148. This arrangement permits compliance with the American Disabilities Act, which requires that any operation involving the opening of a (public) door must be capable of being made by a single operation, or a series of sequential, single operations. In the case of the chain method, with the door 22 closed, the third hinge tongue 90 is aligned with the hinge ears (92 and 94) as a first step, and then the latch pin 24, hanging from the door plate 20, is simply dropped into position as a sequential step.

Figure 6:
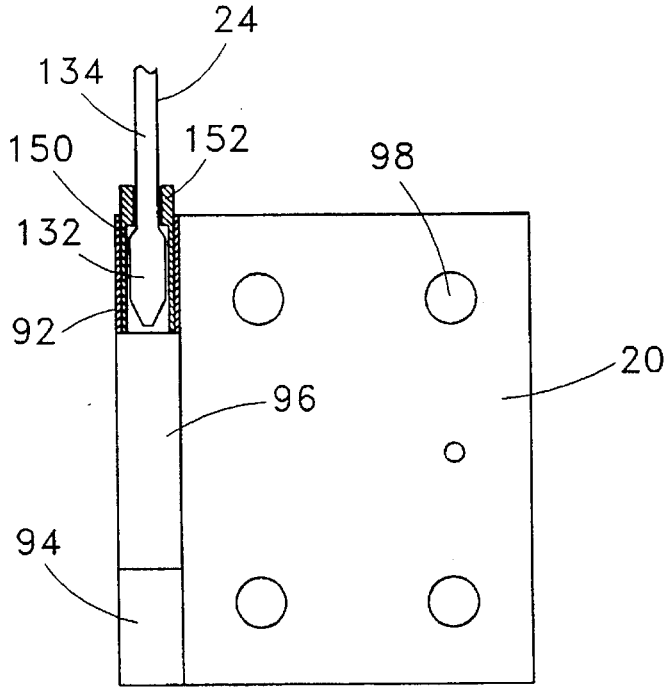
FIG. 6 is a front elevational view of the door plate showing, in cross-section, an alternative latch pin-attachment method.

For households containing children, who would tend to hang and swing on a chain such as chain 146, it is desirable that an alternative method of making the latch pin 24 handy be used. In the second method, and referring now to FIG. 6, a ferrule 150 is press-fitted (or screwed) into the ear bore 104 of the upper hinge ear 92 and then counter-bored. This ferrule 150 permits the latch pin 24 to slidably engage the tongue and ear bores (102, 104 and 106), but prevents the latch pin 24 from being pulled completely out of the hinge joint 108 due to a non-bored and more narrow portion 152. A press-fitted knob (not shown) would be employed with this method.

Figure 7:
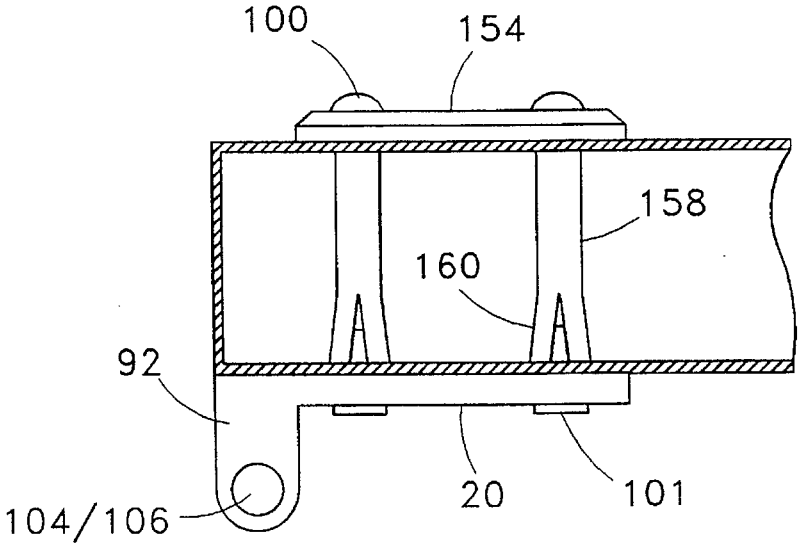
FIG. 7 is a top plan view of the relevant portion of the door security device as implemented with a hollow metal door.

As noted previously, and referring now to the top plan view of FIG. 7, carriage bolts 100 and barrel nuts 101 are used to attach the door plate 20 to the door 22. For greatly increased mounting strength, a reinforcing plate 154 (also shown in FIG. 3) having holes 156 correlating with those of the door plate 20 is employed in a "sandwiching" arrangement on the outside of the door 22. The carriage bolts 100 are first passed through this reinforcing plate 154 and then through the door plate 20 on the inside of the door 22. The reinforcing plate 154 has a beveled ornamental appearance which does not detract from the appearance of the door (the reinforcing plate 154 may also be used for the placement of numbers, as in a hotel). For hollow metal doors (as shown), expansion tubes 158 are provided to prevent collapse of the door 22 upon tightening of the carriage bolts 100. The expansion tubes 158 are sturdy metal sleeves with slotted ends 160 through which the carriage bolts 100 are inserted and which expand to a larger size than the hole drilled for their placement when the barrel nuts 101 are threaded onto the carriage bolts 100. The versatility of being able to use the door security device 10 with a metal is important since new fire codes often require such doors. Finally, it should also be noted that a shim plate (not shown) may also be necessary for placement under either of the wall or door plates (12 or 20) in order to adjust the wall plate 12 and door plate 20 to substantial coplanarity.

In the door security device 10 of the preferred embodiment, the major component parts of the base plate 12, the first and second hinge plates (16 and 18), and the door plate 20 are extrusion products of architectural grade aluminum of the "6063" composition series having a temper of "T5" or "T56," these designations being very well known in the art. Of course, many other high strength metals and metal alloys may be employed as well, including steel and brass. The spring pins (50 and 82) are made of "alloy steel," and the latch pin is made of unhardened C-1018 steel, but again other sturdy metals may be employed. It is important to note that the implemented door security device 10, made of the preferred materials, provides a greater resistance to a door being forcibly opened than the same door when closed and dead-bolted with a standard U.L. rated door knob/latch and dead bolt.

In addition to the above mentioned examples, it is to be understood that various other modifications and alterations with regard to the types of materials used, their method of joining and attachment, and the shapes, dimensions and orientations of the components as described may be made without departing from the invention. Accordingly, the above disclosure is not to be considered as limiting and the appended claims are to interpreted as encompassing the entire spirit and scope of the invention.

INDUSTRIAL APPLICABILITY

The door security device 10 of the present invention is designed to be used with virtually any type of door, including inwardly-opening doors, outwardly-opening doors, double-doors, sliding-doors, and roof-access doors. Many windows are amenable to use of the device 10 as well. The door security device 10 is appropriate for both homes and commercial lodging facilities. The device 10 made of the preferred materials is resistant to hacksaws, bolt-cutters, medium caliber weapons and shotguns, torches/freezing, sledge hammers, and axes. In fact, the device 10 may actually require downsizing under certain application codes to be breakable by a fire axe.

Installation of the door security device 10 is easily accomplished and the use thereof is simple. The device 10 will generally be mounted at about the height of a light switch (the American Disabilities Act requires no greater than 122 cm (48.0 in)), or lower if it is desirable that younger children be able to avail themselves of the device 10 (testing indicated that it took a 6-year old child less than one minute to learn the operation of the device). As noted previously, installation requires that the jamb plate 28 be mounted on the jamb face 34 within a notch as is provided for a typical door knob strike plate 36. A molding 44 will generally require notching for situation of the wall plate 26 as well. When the base plate 12 has been installed, the door plate 20 is installed, with the carriage bolts 100 and expansion tubes 150 (if the door 22 is a hollow metal door), so as to line up with the leading edge of the door 22, making sure that the third hinge tongue 90 is centered within the hinge ears (90 and 92) of the door plate 20.

Employment of the door security device 10 requires only that the latch pin 24 be inserted within the three bores (102, 104 and 106) of the third hinge tongue (90) and the hinge ears (92 and 94) of the door plate 20, such simultaneous insertion, it will now be apparent, being possible only when the door 22 is in the closed or very nearly closed position. When the door 22 is then opened, an extremely secure, locked partial opening is thereby obtained. When use of the door security device 10 is not desired, the latch pin 24 is removed, and the first and second hinge plates (16 and 18) are swung toward the door frame 14, where the first hinge plate 16 may be conveniently placed flushly against the wall plate 26 and stored out of the way.

For the above, and other, reasons, it is expected that the door security device 10 of the present invention will have widespread industrial applicability. The door security device 10 provides substantial advantages in that the device 10 is impossible to unlock from the outside of a door, is virtually indestructible, and is simple in installation and operation. It is also economical to manufacture. Therefore it is expected that the commercial utility of the present invention will be extensive and long lasting.

What is claimed is:

1. A door security device for a first door member and a second door member, at least one of said first and second door members being a door, comprising:

a first hinge member hingedly attached to said first door member;

a second hinge member having a first borehole, said first and second hinge members being hingedly connected;

a door member fixture having a second borehole, said door member fixture being attached to said second door member, the first and second boreholes capable of being substantially aligned when said door is in a closed position;

a hinge pin having an upper stop and a lower stop, said hinge pin being simultaneously insertable within the first and second boreholes when the first and second boreholes are in substantial alignment and hingedly connecting said second hinge member and said door member fixture thereby, the upper and lower stops having a thickness such that said hinge pin is impassable through the first and second boreholes when the first and second boreholes are not substantially aligned; and biasing means for selectively biasing the first and second boreholes in and out of substantial alignment.

2. The door security device of claim 1, wherein the other of said first and second door members is a door frame.

3. The door security device of claim 2, wherein said first hinge member is attached to the door frame, said first hinge member having a generally solid L shape with holes therein for receiving screws in a perpendicular, criss-cross fashion to give a multiplied holding ability upon the door frame thereby.

4. The door security device of claim 1, wherein said biasing means includes at least one of the first and second boreholes being eccentrically bored.

5. The door security device of claim 4, wherein said biasing means further includes one of said second hinge member and said door member fixture having a biasing ramp for peripherally engaging a borehole wall of said first and second boreholes and inducing biasing action thereby.

6. The door security device of claim 1, wherein the attachment of at least one of said first hinge member and said door member fixture to said door includes carriage bolts and an outside reinforcing plate said door having an outside surface, the reinforcing plate being located on the outside surface, the carriage bolts passing first through the reinforcing plate, then through said door, and then through the at least one of said first hinge member and said door member fixture, the strength of the attachment to said door being increased thereby.

7. The door security device of claim 6, wherein said door is a hollow door, said hollow door having opposing interior surfaces, and further including expansion sleeves each having a slotted end, and barrel nuts, the expansion sleeves being disposed between the opposing interior surfaces, the barrel nuts being threadably received by the carriage bolts, the carriage bolts being insertably located within the expansion sleeves, the slotted end of the expansion sleeves expanding to accommodate the reception of the barrel nuts onto the carriage bolts, the expansion sleeves preventing deformation of said door upon tightening of the barrel nuts onto the carriage bolts.

8. The door security device of claim 1, wherein the components thereof are made of extruded aluminum alloy.

9. A lock for limiting the degree to which a door may be opened relative to an associated door member, comprising:

a first fixture for mounting on one of said door and said door member;

a second fixture for mounting on the other of said door and said door member; and linking means for connecting said first and second fixtures and for providing the extent to which said door may be opened, said linking means including a selectively formable hinge joint having at least one ear and a tongue, the ear having an ear borehole, the tongue having a tongue borehole, the ear and tongue boreholes substantially alignable when said door is in a closed position, the hinge joint further having biasing mean for selectively biasing the first and second boreholes in and out of substantial alignment when said door is opened and closed, the hinge joint further including a hinge pin having an upper stop, a lower stop, and a barrel portion, the upper and lower stops having a thickness so as to be impassable through the first and second boreholes when the first and second boreholes are not substantially aligned, the barrel portion having a lesser thickness than the upper and lower stops to permit hinge joint function when the first and second boreholes are not substantially aligned.

10. The lock of claim 9 further including a second ear, and wherein the biasing means includes a biasing ramp extending intermediate the two ears, the biasing ramp peripherally engaging the tongue and inducing biasing action thereby.

11. The lock of claim 10, wherein the tongue borehole is eccentrically bored.

12. The lock of claim 11, wherein the tongue includes an inner periphery, an intermediate periphery, and an outer periphery, the tongue borehole being bi-directionally offset 90 degrees from both the inner and intermediate peripheries in the direction of the outer periphery to create the eccentricity.

13. The lock of claim 11, wherein said door has an inception angle upon opening said door at which angle the first and second boreholes are not substantially aligned, the tongue borehole has a center, the tongue includes an inner periphery, an outer periphery, and a transitional periphery lying between the inner and outer peripheries, the inner periphery having a radius with an origin located at the tonic borehole center, the transitional periphery having a radius shorter than that of the inner periphery with an origin displaced from the tongue borehole center, engagement of the biasing ramp upon the transitional periphery resulting in a minimized inception angle thereby.

14. In a security device for providing limited opening of a first member with respect to a second member, which first member is adapted to mate in a closed position wherein said first and second members are aligned so as to have a substantially coplanar interior surface along a common surface plane, and wherein at least one of said first and second members pivots about a pivot axis with respect to the other to permit a range of open positions, the range of open positions including a partially open position sufficient to permit visual surveillance through an opening formed intermediate said first and second members, and the passage of small objects therethrough, but insufficient to permit passage of large objects or bodies therethrough, the improvement comprising:

a first plate member secured to said first member, said first plate member including a first protruding portion having a first axial bore therethrough, the first axial bore being aligned to extend so as to be parallel to such pivot axis;

a second plate member secured to said second member, said second plate member having a pivotally connected extension portion, the extension portion including a second protruding portion mateable with the first protruding portion in such closed position, the second protrusion including a second axial bore formed therethrough, the second axial bore being formed to extend so as to be parallel to such pivot axis;

an engagement pin adapted to axially slide into, out of, and within the first axial bore and the second axial bore; and means for mutually biasing the first axial bore and the second axial bore such that, in such closed position, said engagement pin slides freely therethrough so as to engage both, while in the open position, said engagement pin cannot slide freely therethrough; wherein the extension portion is mounted in such a manner that said engagement pin may be retained in engagement with the first axial bore and the second axial bore at all positions intermediate such closed position and such partially open position.

15. The improvement of claim 14 and further including capture means for capturing said engagement pin within the first axial bore and the second axial bore at all positions except such closed position and positions very closely associated therewith.

16. The improvement of claim 15, wherein the first and second axial bores have cross-sectional areas, the cross-sectional areas at least partially overlapping from an axial perspective when the first and second protruding portions are mated together, the overlap defining an interface of the first and second axial bores thereby;

the capture means includes first stop means formed on said engagement pin to prevent said engagement pin from sliding beyond an engaged position with the first and second axial bores; and second stop means formed on said engagement pin, opposite to the first stop means, the second stop means being positioned to extend beyond the interface of the first and second axial bores such that the engagement of the second stop means with one of the axial bores prevents the engagement with the other of the axial bores except in the closed position and alignment positions closely associated therewith.

* * * * *